United States Patent [19]

Hoover et al.

[11] Patent Number: 4,941,388

[45] Date of Patent: Jul. 17, 1990

[54] STRING VIBRATION SUSTAINING DEVICE

[76] Inventors: Alan A. Hoover, 4220 E. 11th St., Indianapolis, Ind. 46201; Gary T. Osborne, 6052 N. Guilford Ave., Indianapolis, Ind. 46220

[21] Appl. No.: 350,338

[22] Filed: May 12, 1989

[51] Int. Cl.[5] ..... G10H 3/18; G10H 3/24

[52] U.S. Cl. ..... 84/726

[58] Field of Search ..... 84/726, 727, 728, DIG. 10

[56] References Cited

U.S. PATENT DOCUMENTS

| | | |
|---|---|---|
| 472,019 | 3/1892 | Ohmart . |
| 1,002,036 | 8/1911 | Clement . |
| 1,893,895 | 1/1933 | Hammond . |
| 2,001,723 | 5/1935 | Hammond . |
| 2,600,870 | 6/1952 | Hathaway et al. . |
| 2,896,491 | 7/1959 | Lover . |
| 3,185,755 | 5/1965 | Williams et al. . |
| 3,612,741 | 10/1971 | Marshall . |
| 3,742,113 | 6/1973 | Cohen . |
| 3,813,473 | 5/1974 | Terymenko . |
| 4,075,921 | 2/1978 | Heet . |
| 4,236,433 | 12/1980 | Holland . |
| 4,484,508 | 11/1984 | Nourney . |
| 4,852,444 | 8/1989 | Hoover et al. ..... 84/DIG. 10 X |

FOREIGN PATENT DOCUMENTS

| | | |
|---|---|---|
| 461969 | 12/1949 | Canada . |
| 673375 | 1/1930 | France . |
| 961543 | 5/1950 | France . |

OTHER PUBLICATIONS

Osborne, Description of Infinite Guitar Sustain Device, 1987.

Lawrence, "Kramer Floyd Rose Sustainer Solid Body Guitar", *Guitar World*, Jul. 1989.

Osborne, Description of a 1971 Les Paul Recording Guitar.

*Primary Examiner*—W. B. Perkey

*Attorney, Agent, or Firm*—E. Victor Indiano

[57] ABSTRACT

A sustaining device is disclosed for prolonging the vibration of a string of a stringed musical instrument, such as an electrical guitar having a magnetic pickup responsive to a change in the magnetic field caused by vibration of the string. The sustaining device includes the magnetic string driver disposed in magnetic proximity to the pickup. An amplifier is coupled between the pickup and the driver for amplifying current from the pickup to the driver to impart sufficient magnetic drive energy to the driver to produce sustained vibration of the string. An unbalancing device is provided for creating a magnetic imbalance between the pickup and the driver to minimize direct magnetic feedback between the pickup and the driver. This unbalancing device can take the form of an unbalanced pickup, an unbalanced driver, or a shunt plate disposed between the pickup and the driver.

31 Claims, 8 Drawing Sheets

STRING VIBRATION SUSTAINING DEVICE

BACKGROUND OF THE INVENTION

The present invention relates to an electronic device for use in connection with a musical instrument, and more particularly to an electronic device for sustaining the vibration of a string of a stringed musical instrument.

It has long been known that an amplifier could be coupled to a stringed musical instrument to amplify the sound produced by the vibration of the strings of the instrument. Probably the most popular example of such an electrically amplified stringed musical instruments is an electric guitar. An electric guitar typically includes a plurality of strings that extend between the head of the guitar and the body of the guitar, with a fretted neck interposed between the head and body of the guitar.

In an electric guitar, one or more magnetic pickups are placed on the body of the guitar in magnetic proximity to the strings of the guitar. The magnetic pickups are responsive to the change in magnetic flux caused by the vibration of the strings. This magnetic energy picked up by the pickup is then transmitted to a separate amplifier and speaker.

It has long been known that a pickup and external amplifier arrangement on an electric guitar can not only adjust the volume of the sound produced by the guitar, but can also be used by the musician to alter the nature of the sound produced by the guitar. One means for altering this sound is to introduce vibrational feedback into the system to prolong the vibration of the strings of the guitar.

An early method for producing such sustained vibration was for the musician to move the musical instrument in close proximity to the speaker of the amplifier through which the guitar was being amplified. In such a situation, the acoustic energy caused by the sound waves emanating from the speaker of the amplifier would establish a sympathetic vibration of the strings. The vibration of the strings induced by the speaker would then be translated into magnetic flux energy picked up by the pickup means. This magnetic flux energy would then be transmitted through the external amplifier, through the separate amplifier, and would be transformed into sound energy through the speaker of the amplifier. Typically, this situation would result in a "feedback" loop which sustained the vibration of the strings of a musical instrument, and hence the duration of the sound produced by the plucking of the string.

One difficulty however with this method of introducing feedback is that it is often difficult to control the amount and type of feedback produced. Hence, it is difficult to control the sound produced through the use of this feedback system. Several devices have been invented, to overcome the problems discussed with the above method of sustaining string vibration.

A typical, prior art sustain device 8 is shown in FIG. 1 as including a magnetic pickup 10, a magnetic driver 12, and an amplifier 14 interposed in a circuit between the pickup 10 and driver 12. The pickup is typically comprised of one or more pickup coils, such as pickup coil 11. The driver 12 is typically comprised of one or more of the driver coils, such as driver coil 13.

The sustain system 8 may be used to sustain the vibration of a single string, such as string 16, or a plurality of strings, such as the 4, 6, or 12 strings typically found on an electric guitar. The sustain system is usually disposed on a counter-sunk portion of the upper surface of the body of the electric guitar, so that the pickup 10 and driver 12 are in magnetic proximity to the string 16 of the instrument.

The pickup 10 and driver 12 are constructed generally similarly. Both the pickup 10 and driver 12 are constructed of a number of turns of a conductor means, such as a wire 18, 20 which is wound around a magnetic core 22, 24, respectively. The cores 22, 24 are generally either a permanent magnet, or a ferrous material in contact with a permanent magnet, to provide a permanent magnetic flux through the center of the respective pickup coil 11 and driver coil 13.

For the purposes of this discussion as to the manner in which such a sustain system works, the pickup coil 11 and driver coil 13 are modeled as ideal inductors, $L_P$ and $L_D$, respectively, having $_P$, and $N_D$, respectively, turns of wire in series with a resistive element, such as resistor $R_P$ 26 and resistor $R_D$ 28, respectively. The amplifier 14 is modeled as having infinite input impedance, zero output impedance, and a voltage gain of A. The string 16 is assumed to be under tension, free to vibrate, and secured at both ends.

A condition exists in all prior sustain systems using a magnetic pickup and driver in conjunction with an amplifier to sustain string vibration. When the gain of the amplifier 14 is of a sufficiently high level to achieve sustain of the string 16, a portion of the driver's 12 magnetic field F is present at the pickup 10. This magnetic field induces the pickup 10 to create a voltage. The pickup voltage is amplified and regenerated by the driver 16, which then is picked up by the pickup 10, to induce the pickup 10 to create a greater voltage.

When the amplifier gain is increased to the point wherein the magnetic loop gain is greater than or equal to unity, and the loop's phase angle is zero degrees, 360 degrees, 720 degrees, or some whole multiple of 360 degrees, the classical nyquist condition will be met, and the system will oscillate. Since the frequency of oscillation is generally determined by the self-resonant frequency of the pickup, the driver, and other phase and amplitude characteristics of the amplifier, the oscillation frequency has no musical relationship to the string vibration frequency. Oscillation is therefore undesirable.

A second problem associated with direct magnetic feedback between the driver and pickup is the contamination of the pickup signal with noise and distortion produced by the amplifier means. The presence of amplifier noise and distortion in the pickup signal produces an unnatural tone when the pickup is used in conjunction with a loudspeaker to monitor the tone produced by the vibrating string.

One common solution to the direct magnetic feedback problem is to decrease amplifier gain. However, this decrease in amplifier gain also reduces the ability of the system to pick up and sustain slight string vibrations. Additionally, the amount of time required for the system to reach a steady state sustain condition (where the maximum string vibration amplitude is limited by the maximum dynamic range of the system) is lengthened.

A second, prior art solution to the problems of direct magnetic feedback is to spatially separate the pickup and driver by a greater distance. One example of a device which reduces direct magnetic feedback by such a spatial separation is the SUSTAINIAC Model B sustain system, manufactured by Maniac Music, Inc. of Indianapolis Ind., which is described in the applicants' U.S. patent application Ser. No. 06/937,871, filed on Dec. 4, 1986.

In the SUSTAINIAC sustain device, the magnetic driver is a magnetic vibrational transducer which attaches to the head, stock or body of the musical instrument to provide an acoustic vibrational feedback to the string through the string supports. Although this system performs its function well, room for improvement exists. Particularly, room for improvement exists in the area of providing a more predictable phase relationship between the transducer drive current and the string vibration, as the SUSTAINIAC sustain system transducer must act on the string through the complex acoustic time delays and phase anomalies of the musical instrument's body resonance.

Another variation on this second solution is to place the pickup and driver at opposite ends of the strings. One difficulty with this method however is that it precludes the use of frets on a musical instrument. Thus, although this second method would adapt well to a piano, it adapts poorly to a guitar.

A third method of overcoming direct magnetic feedback is to eliminate one or both of the magnetic components. For example, the magnetic pickup may be replaced with a piezoelectric device, or a strain gauge which can sense string vibration while being insensitive to the driver's magnetic field.

A fourth method of overcoming the problem of direct magnetic feedback is to provide the pickup and driver with a very small air gap between the magnetic poles. The commercially available E-bow sustain system, manufactured by Gregory A. Heet of Los Angeles, Calif., and described in U.S. Pat. No. 4,075,921, embodies this type of approach. One difficulty with this approach is that the strings must be in very close proximity to the pickup and driver, and the string vibrational excursion must be minimized to avoid direct contact between the strings and the pickup and driver.

A fifth, prior art method for overcoming the problems caused by direct magnetic feedback is to provide the pickup with a humbucking apparatus to cancel the effects of uniform external magnetic fields. Such a humbucking apparatus is described by Cohen in U.S. Pat. No. 3,742,113. Cohen describes the humbucking apparatus as a "differential pickup of the type well known in the state of the art" constituted by two coils wherein "both coils respond to magnetic fields identically." One difficulty with such an approach however, is that the humbucking pickup does not provide optimum rejection of the non-uniform magnetic field generated by the driver due to the balanced design of the pickup. As will be appreciated, the driver's magnetic field is non-uniform in close proximity to the driver due to the inverse square law of magnetic field intensity. This law provides that as distance from the driver is increased, the magnetic field becomes more uniform. It will be noticed that Cohen provides a shield, consisting of layers of high and low permeability material around the perimeter of the humbucking pickup, to lessen the effects of direct magnetic feedback. The perimeter shield does not affect the magnetic balance of the humbucking pickup due to the shield's symmetry.

A variation of this fifth method for overcoming the problems of direct magnetic feedback is to provide the driver with a humbucking apparatus to allow far field cancellation of the driver's generated magnetic field. This is obvious since the driver is the electrical "dual" of the humbucking pickup described in U.S. Pat. No. 3,742,113. One problem with this approach, however is that the humbucking driver does not provide an optimally cancelled magnetic field in the proximity of the pickup, due to the balanced design of a humbucking driver.

A sixth prior art method for overcoming the problems caused by direct magnetic feedback is to provide a magnetic shield to encase the pickup. Such a shield is described in Holland's U.S. Pat. No. 4,236,433. One difficulty with this method, however, is that it encases a portion of the string and the encased string portion may not be plucked or struck.

A seventh prior art method for overcoming the problems caused by direct magnetic feedback is to provide a device wherein the pickup is located between identical drivers wired electrically out of phase. Such a device is shown in Cohen's U.S. Pat. No. 3,742,113. One difficulty with this device, however, is that it requires the drivers to be placed in "shields of magnetic ingot iron" to minimize direct magnetic feedback. A second difficulty with this device is that the driver cores must be "provided with a concave figure to focus or concentrate the flux generated on a string."

Although the above described attempts to solve the problem of direct magnetic feedback all perform their intended function, to one extent or another, room for improvement still exists.

Thus, it is one object of the present invention to provide a sustain device which maximizes the ability to sustain the vibration of a string, while minimizing the effects of direct magnetic feedback associated therewith.

SUMMARY OF THE INVENTION

In accordance with the present invention, a sustaining device is provided for prolonging the vibration of a string of a stringed musical instrument having magnetic pickup means responsive to a change in a magnetic field caused by vibration of the string. The sustaining device comprises a magnetic string driver means in magnetic proximity to the pickup means. An amplifier means is coupled between the pickup means and the driver means for amplifying current from the pickup means to the driver means to impart sufficient magnetic driver energy to the driver means to produce sustained vibration of the string. An unbalancing means is provided for creating a magnetic imbalance between the pickup means and the driver means to minimize direct magnetic feedback between the pickup means and the driver means.

In one aspect of the present invention, a dual coil magnetic pickup is unbalanced to create a cancellation effect of the electrical impulses resulting from the pulsating magnetic field radiated by the magnetic driver. The pickup's output may thus be amplified and delivered to the driver to regenerate and sustain vibration of the string while the pickup remains relatively insensitive to the driver's magnetic field.

In a second aspect of the present invention, a dual coil magnetic driver is unbalanced to produce a cancellation of its emitted magnetic field in the proximity of the magnetic pickup. The pickup's output may thus be amplified and delivered to the driver to regenerate and sustain vibration of the string while the driver's resultant magnetic field produces relatively little effect on the pickup.

A variety of methods are disclosed to produce this unbalancing effect in the pickup, the driver, or both.

In another embodiment of the invention, a shunt plate is used to magnetically reduce direct magnetic feedback. In a fourth aspect of the invention, two or more pickups are combined to be relatively insensitive to direct magnetic feedback produced by a single driver being used to regenerate and sustain string vibration. In a fifth aspect of the invention, two or more drivers are used to regenerate and sustain string vibration by being combined to produce relatively little direct magnetic feedback to a single pickup.

These and other aspects of the present invention will become apparent to those skilled in the art upon consideration of the following detailed descriptions of the preferred embodiments exemplifying the best mode of carrying out the invention as perceived presently.

DETAILED DESCRIPTION OF PREFERRED EMBODIMENTS

Figure 1:
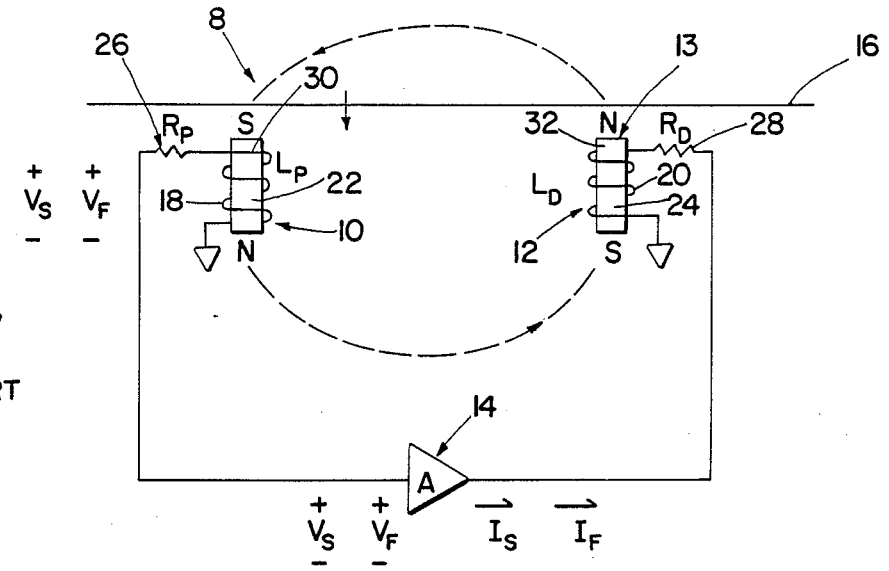
Fig. 1 PRIOR ART
FIG. 1 A schematic view of a prior art sustained circuit.

A description of the workings of a typical sustain device will be described with reference to FIG. 1. As discussed above, FIG. 1 represents a prior art sustain device.

A downward motion of string 16 causes an increase in the magnetic flux in the core 30 of the pickup 10. This increase in the magnetic flux is converted to voltage $V_S$ by Faraday's Law, $V=N\ (DP/DT)$ where DP/DT is the change in magnetic flux through the coil 11 with respect to time, and $N_P$ is the number of turns of wire 18 around the core 30 of the pickup. Amplifier 14 produces current $I_S$ which flows through the driver coil 13 producing an increase in the driver's 12 magnetic field F which further attracts the string 16, thereby reinforcing the downward motion of the string 16.

During the next half cycle of the string's natural harmonic motion, the upward motion of the string 16 causes a magnetic flux decrease in the pickup producing voltage $-V_S$ which is opposite in polarity to voltage $V_S$. Amplifier 14 produces current $-I_S$ which lessens the driver's 12 magnetic field, thereby causing the string 16 to be attracted with a lesser force. This reinforces the string's 16 upward motion.

The natural harmonic motion of the string 16 is regenerated and sustained by positive feedback. However, there is an additional side effect.

A portion of the magnetic field F of the driver 12 passes through the core 22 of the pickup 10. Thus, an increase in the magnetic field of the driver 12 will be converted to voltage $V_F$ by the pickup 10. Amplifier 14 then produces current $I_F$ which further increases the driver's 12 magnetic field F. This positive magnetic feedback condition causes system instability. In practice, this system instability frequently leads to an uncontrolled oscillation whose frequency is typically musically unrelated to the frequency of the vibrating string 16. The uncontrolled oscillation is therefor undesirable.

Figure 1A:
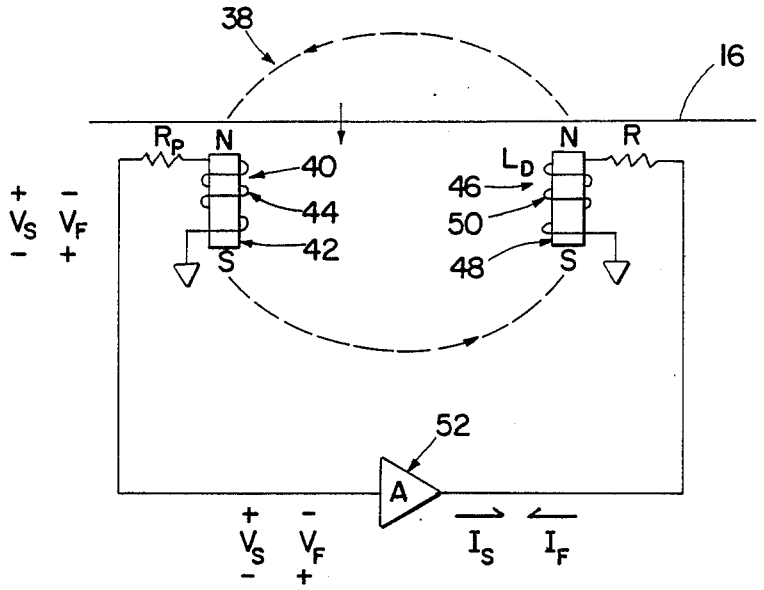
Fig. 1A PRIOR ART
FIG. 1*a* A schematic view of another embodiment of a prior art sustain circuit.

A schematic view of another embodiment of a sustain device is shown in FIG. 1*a* which illustrates how positive string vibration feedback and negative direct magnetic feedback are established by reversing the coil and magnetic pole of the pickup.

Referring back to FIG. 1, it will be noticed that the pickup coil 11 and driver coil 13 are arranged so that the south pole S of core 22 of pickup coil 11 is disposed adjacent to the north pole N of core 24 of driver coil 13.

FIG. 1*a* shows a circuit 38 mounted adjacent to a string 16 of a stringed musical instrument (not shown). The circuit 38 includes a pickup coil 40 having a core portion 42, having a north pole end and a south pole end designated as N and S, respectively. A wire 44 is wrapped around the core portion 42, a specified number of "turns". The circuit also includes a driver coil 46 having a core portion 48. Core portion 48 includes a north pole end and a south pole end, designated as N and S, respectively. A wire 50 is wrapped a predetermined amount of turns around the core portion 48 of the driver coil 46. It will be noticed that, unlike the circuit 8 shown in FIG. 1, the circuit 38 shown in FIG. 1*a* is constructed so that the respective North poles N of both the pickup coil 40 and the driver coil 46 are disposed adjacent to each other, with the South poles S of both the pickup coil 40 and driver coil 46 also being disposed adjacent to each other.

In operation of the embodiment shown in FIG. 1*a*, the string's natural harmonic motion is sustained. A downward motion of the string creates voltage $V_S$. Amplifier 52 produces current $I_S$ which flows through the driver coil 46 producing an increase in the driver's magnetic field, which further attracts the string 16.

Upward motion of the string 16 produces voltage $-V_S$, and amplifier 52 produces current $-I_S$ which lessens the driver's magnetic flux. This causes the string 16 to be attracted with a lesser force. In circuit 38, magnetic feedback is suppressed. An increase in the magnetic field F of the driver 46 will be converted to voltage $V_F$ by the pickup. Amplifier 52 then produces current $I_F$ which lessens the driver's magnetic field F, thereby reducing voltage $V_F$ and so on.

The applicants have learned that several general rules exist relating to string vibration feedback sustain systems, and the manner to exploit such systems to reduce problems caused by oscillation.

The first general rule is that, for a positive string vibration feedback sustain system having a pickup and a driver with one or more coils, negative feedback is established when the closest pickup and driver coils are of like magnetic polarity, such as is illustrated in FIG. 1*a*.

The second general rule is that, for a positive string vibration feedback sustain system having a pickup and a driver with one or more coils, positive magnetic feedback is established when the closest pickup and driver coils are of opposite magnetic polarity, such as is illustrated in FIG. 1. By shifting or inverting the phase response of the sustain system, string harmonics can be selectively sustained. (A detailed discussion of the use of negative string vibration feedback to selectively sustain string harmonics is provided in U.S. patent application No. 06/937,871, discussed above.)

Since the phase shift affects the resultant magnetic feedback signal as well as the string feedback signal, two or more general rules are established for a negative string vibration feedback sustain system. These two general rules are referred to herein as the third general rule and the fourth general rule.

The third general rule is that, for a negative string vibration feedback sustain system having a pickup and a driver with one or more coils, negative feedback is established when the closest pickup and driver coils are of opposite magnetic polarity, as is illustrated in FIG. 1.

The fourth general rule is that, for a negative string vibration feedback sustain system having a pickup and a driver with one or more coils, positive magnetic feedback is established when the closest pickup and driver coils are of like magnetic polarity, as is illustrated in FIG. 1*a*.

Throughout the previous discussion, it has been assumed that the phase and amplitude characteristics of the pickup, driver and amplifier remain constant with changing frequency. In practice, this is usually not the case. All three components (pickup, driver and amplifier) typically introduce distortions in phase and amplitude response, particularly at frequencies relating to the upper portion of the audio band. Phase shifts introduced by the system components have been known to add up to 180° or more, therefore causing a phase inversion. A phase inversion introduced by the system components turns negative magnetic feedback into positive magnetic feedback.

Since phase inversions occur generally at higher audio frequencies, the result on the controlled oscillation is generally high in pitch. A low pass filter may be added to the signal path to decrease high frequency gain and stop uncontrolled oscillation if the frequency at which the phase shift occurs is high enough. Typically the phase shift is high enough if the phase shift is above the practical range of string vibration frequencies. The use of such a low pass filter is described in more detail in the applicants' '871 patent application, discussed above. Alternately, or in conjunction with a low pass filter, the magnetic polarity of the closest pickup and driver coils may be arranged to provide negative magnetic feedback and positive string vibration feedback by taking into account any phase inversion introduced by the system components and disposing the relative magnetic polarities of the closest pickup and driver coils appropriately, as given by the above four general rules.

As discussed above, one of the objects sought by the applicant's invention is to provide an "unbalancing means" in a pickup and sustain system. The purpose of the unbalancing means is to create a magnetic imbalance between the pickup means and the driver means to minimize direct magnetic feedback between the pickup and the driver. By so minimizing the direct magnetic feedback between the pickup and the driver, the effects of direct magnetic feedback can be reduced substantially.

Figure 2:
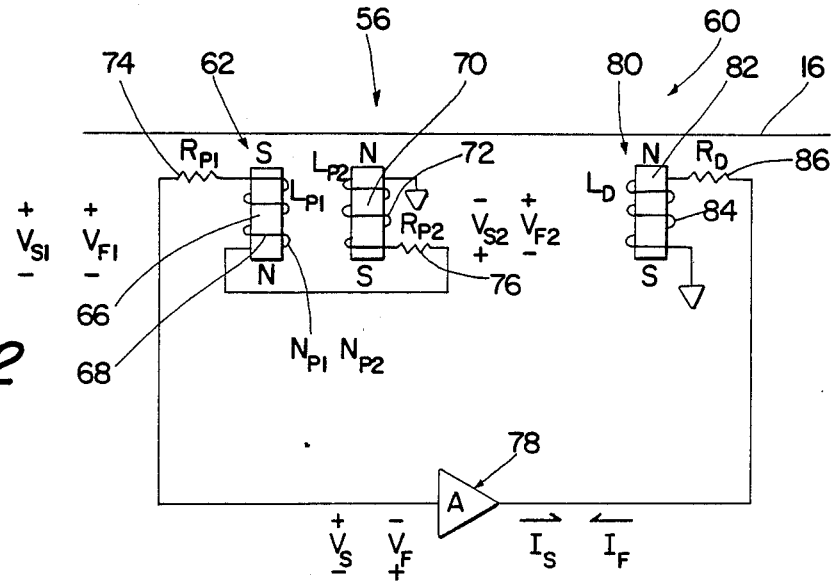
FIG. 2 A schematic view of the sustain circuit of the present invention.
Figure 3:
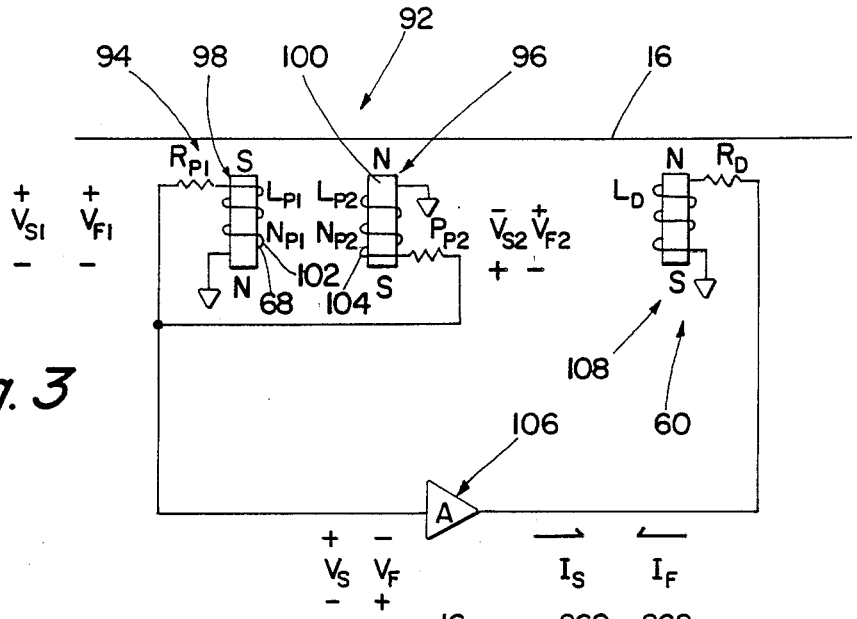
FIG. 3 A schematic view of a circuit of another embodiment of the present invention.

FIGS. 2 and 3 illustrate how this unbalancing is achieved by providing an unbalanced pickup as the unbalancing means.

Turning now to FIG. 2, a circuit 56 for a sustaining device is shown which includes a pickup means 58 and a driver means 60. The pickup means 58 includes a first pickup coil 62 and a second pickup coil 64. The second pickup coil 64 is placed closer to driver 60 than the first pickup coil 62 is placed to driver 60. The first pickup coil 62 includes a magnetic core 66 having a north pole end, N, and a south pole, S. An electrical conductor, such as wire 68 is wrapped around the magnetic core 66, a pre-determined amount of turns, $N_{P1}$. The second pickup coil 64 also includes a magnetic core 70 having a north pole, N, and a south pole, S. An electrical conductor such as wire 72 is wrapped a number of turns, $N_{P2}$ around the magnetic core 70. The inductance of the pickup coils 62, 64 is given by $L_{P1}$ and $L_{P2}$, respectively.

The first and second pickup coils 62, 64 are coupled in series. Appropriate resistors 74, 76 are shown in the circuit to represent the pickup coil resistance provided by coilings of wire, with resistor 76 being placed in series with wire 72 to represent the resistance of wire 72. Resistor 74 is placed in series with wire 68 to represent the resistance of wire 68. Driver coil 80 is constructed similarly to the pickup coils 62, 64, and includes a magnetic core 82 around which is wrapped a wire 84. A resistor 86 is placed in the circuit 56 in series with wire 84 to represent the resistance of wire 84. As shown in FIG. 2, the pickup means 58 comprises a dual coil pickup, and the driver means 60 comprises a single coil driver. Additionally, the second pickup coil 64 is placed closer to the driver coil 80 than the first pickup coil 62 is placed to the driver coil 80. Both the pickup coils 62, 64, however, are in sufficient proximity to the driver so as to be influenced by the magnetic field generated by the driver coil 80. Typically, this magnetic proximity will exist in cases wherein the pickup coils 62, 64 and driver coils 80 are both placed on the body portion of the instrument. Usually, the body portions of most instruments are not large enough to enable one to place the pickup and the driver at a sufficient distance to prevent the pickup from being influenced by the magnetic field exerted by the driver.

Since the second pickup coil 64 is closer to the driver coil 80, the second pickup coil 64 receives a greater proportion of driver coil's 80 magnetic field in its magnetic core 70, than is received in the magnetic core 66 of the first pickup coil 62. Because of this arrangement, $V_{F2}$ is greater than $V_{F1}$. Further, since $V_F = V_{F2} - V_{F1}$, $V_F$ does not equal zero. In the above equations, $V_{F1}$ equals the voltage produced by the first pickup 62 in response to a change in the magnetic field generated by the driver 60, and $V_{F2}$ equals the voltage produced by the second pickup coil 64 in response to changes in the magnetic field generated by the driver coil 80. $V_F$ equals the total voltage produced by the pickup means in response to changes in the magnetic field generated by the driver coil 80.

The fact that $V_F$ does not equal zero leads to the possibility that unwanted oscillation will occur. To overcome this oscillation, it is desirable to force the voltage, $V_F$ to zero. Voltage $V_F$ can be forced to zero by unbalancing the pickup 58 so that the voltages $V_{F1}$ and $V_{F2}$ are equal. That is, something should be done to alter the relative magnetic sensitivities of the coils 62, 64 of the pickup 58. Thus, theoretically $V_F$ equals zero for an appropriately unbalanced pickup when the unbalancing method exactly compensates for the differences in the driver magnetic fields present at the two pickup coils 62, 64.

There are several ways to manipulate the components of the circuit 56 to achieve this unbalanced effect.

The first method of unbalancing the pickup means 58 is by altering the cross-sectional areas of the magnetic cores 66, 70 of the first and second pickup coils 62, 64. By providing a magnetic core 70 in the second pickup coil 64 which has a smaller cross-sectional area than the magnetic core 66 of the first pickup coil 62, less magnetic flux is attracted into the magnetic core 70 of the second pickup coil 64. This lessens the voltage $V_{F2}$. Through a proper design of the cross-sectional areas of the respected magnetic cores 66, 70 of the first and second pickup coil 62, 64, one can achieve a net voltage $V_F$, which approximates zero. In creating such a proper design, one should take into account criteria such as the material from which the magnetic cores 66, 70 are made, the distance between the magnetic cores 66 and 70, and the distance between the respective magnetic cores 66, 70 (and hence pickup coil S 62, 64), and the driver coil 80. Through a proper selection of core material(s), and proper spacing, a pickup means can be unbalanced so that the voltage $V_{F2}$ sensed by the second pickup coil 64 is equal to the opposing voltage $V_{F1}$ sensed by the first pickup coil, so that the net voltage $V_F$ sensed by the pickup means 58 approximates zero.

Another method of manipulating the components of circuit 56 is by altering the magnetic permeability of the magnetic cores 66, 70 of the respective first and second pickup coils 62, 64. By providing a magnetic core 70 of second pickup coil 64 which is comprised of a material having less magnetic permeability than the material from which the magnetic core 66 of the first pickup coil is comprised, less magnetic flux is attracted into the second pickup coil 64. This decreases the voltage $V_{F2}$ sensed by the second pickup coil 64. Through a proper selection of the respective materials from which the magnetic cores 66, 70 are made, the voltage $V_{F2}$, sensed by the second pickup coil 64 will be equal to the opposing voltage $V_{F1}$ sensed by the first pickup coil 62, so that the next voltage equals, or approximates, zero. To properly select the materials from which the magnetic cores 66, 70 are made, criteria such as the permeability of the material chosen, the cross-sectional area S of the magnetic core 66, 70 and the distance between the pickup coils 62, 64 and the driver coil 80, and the distance between the first and second pickup coils, 62, 64, themselves, should be considered.

A third method for manipulating the components of circuit 56, shown in FIG. 2 to unbalance the pickup 58 is to unbalance the turns of wire $N_{P1}$, $N_{P2}$ around each of the respective magnetic cores 66, 70 of the first and second pickup coil 62, 64. In order to unbalance the pickup 58 through the choice of a number of turns of wire around each core 66, 70, the number of turns, $N_{P1}$ of wire 68 around the magnetic core 66 of first pickup coil 62 is greater than the number of turns $N_{P2}$ of wire 72 around the magnetic core 70 of the second pickup coil 64. This difference in the number of turns around each of the respective coils 62, 64 enables the first pickup coil 62 to produce an opposing voltage $V_{F1}$ which approximates, or is equal in magnitude to the voltage $V_{F2}$ of the second pickup coil 64, causing the difference in voltage between the first and second pickup coils 62, 64 to approximate zero.

Another embodiment of a circuit 92 utilizing a sustain system of the present invention is shown in FIG. 3. Similar to FIG. 2, circuit 92 of FIG. 3 includes a pickup means having first pickup coil 94 and a second pickup coil 96, each of which includes core portions 98, 100 respectively. Wires 102, 104, respectively, are wrapped around the core portions 98, 100 a predetermined amount of times, herein also designated as $N_{P1}$ and $N_{P2}$. Unlike circuit 56 (FIG. 2), circuit 92 (FIG. 3) has the first and second pickup coils 94, 96 coupled in parallel, rather than in series. The driver means 60 of circuit 92 comprises a single driver coil 108. An amplifier 106 is coupled between the pickup coils 94, 96 and the driver coil 108.

As with circuit 56, the means for unbalancing the sustain system of circuit 92 is achieved through unbalancing the pickup means.

Several methods exist for unbalancing the pickup means of the circuit 92. The first method of unbalancing circuit 92 is by altering the cross-sectional areas of the respective magnetic cores 98, 100. By providing the core 100 of the second pickup coil 96 with a smaller cross-sectional area than the cross-sectional area of the core 98 of first pickup coil 94, less magnetic flux is attracted into the second pickup coil 96, core 100. This lessens the voltage $V_{F2}$ sensed by the second pickup coil 96. By properly choosing the respective sizes of the cross-sectional areas of the cores, 98, 100, the voltage $V_{F2}$ sensed by the second pickup coil 96 can approximate or equal the opposing voltage $V_{F1}$ sensed by the first pickup coil 94, so that the net voltage V, approximates zero. Another method for unbalancing the circuit 92 is by altering the magnetic permeability of the cores 98, 100 of the pickup coils 94, 96. By making the core 100 of the second pickup coil 96 from a material having less magnetic permeability, than the material from which the core 98 of first pickup coil 94 is made, less magnetic flux is attracted into the second pickup coil 96. This lessens the voltage $V_{F2}$ sensed by the second pickup coil 96. The materials from which the cores 98, 100 are made, the spacing between the cores, and the spacing between the respective cores 98, 100 and the driver coil 108, should be chosen so that the voltage $V_{F2}$ sensed by the second pickup coil 96, is approximately equal to the opposing voltage $V_{F1}$ sensed by the first pickup coil 94, so that the net voltage $V_F$ approximates zero.

Another method for unbalancing circuit 92 is to differ the number of turns $N_{P1}$, $N_{P2}$ of wire 102, 104, respectively around each core 98, 100 of the first and second pickup coils 94, 96. To unbalance circuit 92 properly, $N_{P1}$ should be greater than $N_{P2}$. That is, the number of turns of wire 102 around the core 98 of first pickup coil 94 should be greater than the number of turns of wire 104 around core 100 of second pickup coil 96. The greater number of turns around first pickup coil 94 enables the first pickup coil 94 to produce an opposing voltage $V_{F1}$ which is preferably equal in magnitude to the voltage $V_{F2}$, making the difference voltage $V_F$ approximate zero.

Figure 7:
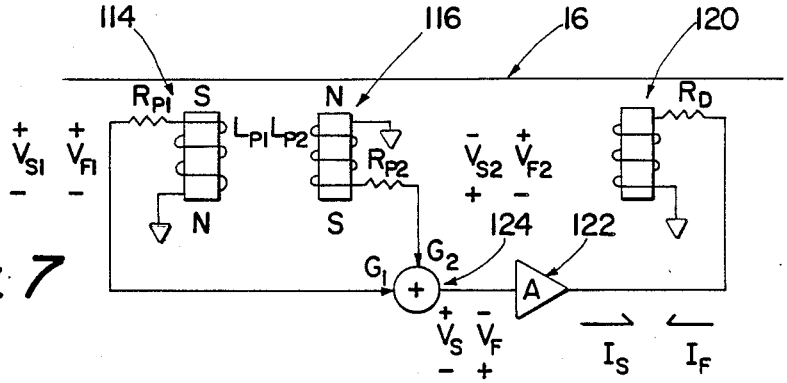
FIG. 7 A schematic view of a circuit of another embodiment of the present invention.

Another embodiment of the present invention is circuit 112 shown in FIG. 7. Circuit 112 illustrates another unbalancing means for use with parallel dual coil pickups. Circuit 112 includes a first pickup coil 114, a second pickup coil 116 and a driver coil 120. Circuit 112 also includes an amplifier 122 and an adder means 124. The outputs from the first and second pickup coils 114, 116 are applied to the adder 124. The adder 124 is configured so that the input gains are different, with the input gain $A_1$ from the first pickup coil 114 being greater than the input gain $A_2$ from the second pickup coil 116. The adder's 124 unequal input gains $A_1$, $A_2$ compensate for the unequal voltages $V_{F1}$ and $V_{F2}$, so that the net combination of $V_{F1}$, and $V_{F2}$ at the output of the adder 124 approximates zero.

Figure 8:
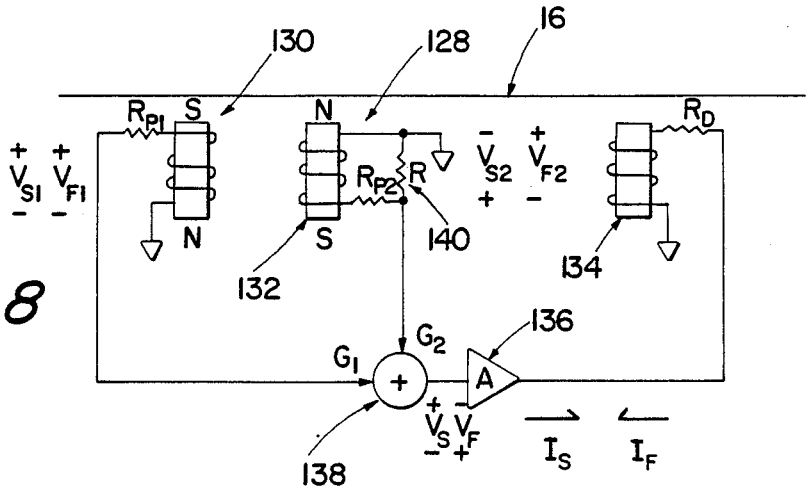
FIG. 8 A schematic view of a circuit of another embodiment of the present invention.

Another embodiment of the present invention is shown in FIG. 8 which also illustrates a circuit 128 having first and second parallel coupled pickup coils 130, 132 and a driver coil 134. Circuit 128 also includes an amplifier 136 and an adder 138. The outputs from the first and second pickup coils 130, 132 are applied to the adder 138. Resistor 140 forms a voltage divider with the wire resistance $R_{P2}$ of the second pickup coil 132 that lessens the magnitude of voltage $V_{F2}$. This reduction in the magnitude of voltage $V_{F2}$ allows the gain $A_2$ from the second pickup coil 132 to be less than or equal to the gain $A_1$ from the first pickup coil, so that the net voltage $V_F$ approximates zero.

Figure 9:
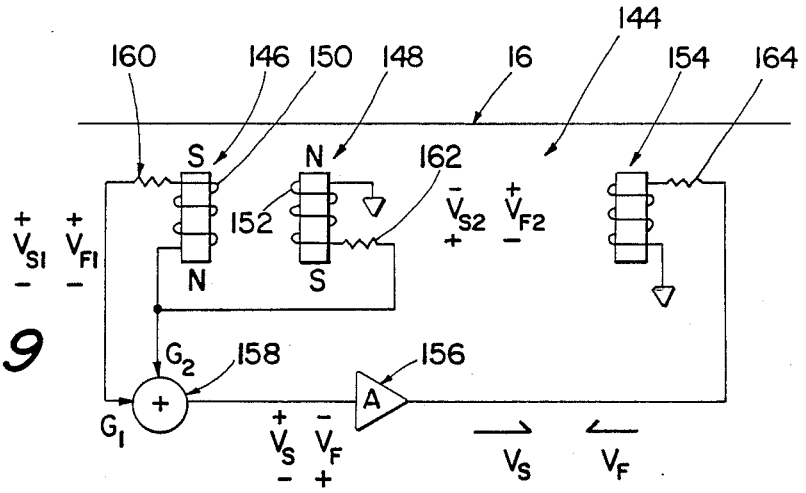
FIG. 9 A schematic view of a circuit of another embodiment of the present invention.

Another embodiment of a circuit for a sustaining device of the present invention is shown in FIG. 9. Circuit 144 includes a first pickup coil 146 and a second pickup coil 148 coupled in series. Each of the first and second pickup coils 146, 148 have poles including respective north, N, and south, S, poles, and conductors 150, 152 wrapped around the core portions. The circuit 144 also includes a driver coil 154, an amplifier 156, an adder 158 and three resistors, 160, 162, and 164 that represent the respective wire resistances of pickup coils 146, 148 and driver coil 154. The adder 158 combines $V_{F1}$ and $V_{F2}$ to provide a condition wherein $V_F$ approximates zero when $A_1$ $(V_{F1}-V_{F2})$ approximates or equals $A_2$ $(V_{F2})$. In the above equation, $A_1$=the gain of the adder 158 with respect to the difference voltage, $V_{F1}-V_{F2}$; $A_2$=the gain of the adder 158 with respect to the voltage $V_{F2}$; $V_{F1}$=the voltage produced by the first pickup coil in response to changes in the magnetic field generated by the magnetic string driver coil 154; and $V_{F2}$=the voltage produced by the second pickup coil 148 in response to changes in the magnetic field generated by the magnetic string driver 154.

Figure 10:
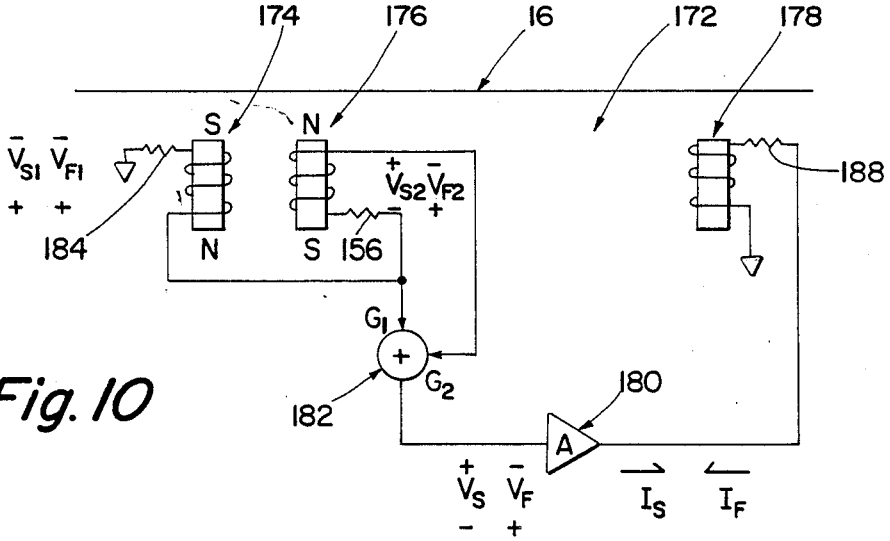
FIG. 10 A schematic view of a circuit of another embodiment of the present invention.

The circuit 172 shown in FIG. 10 provides a generally similar function to the circuit 144 shown in FIG. 9. Circuit 172 includes first and second pickup coils 174, 176, a driver coil 178, an amplifier 180 and an adder 182. Additionally, circuit 172 also includes three resistors, 184, 186 and 188 that represent the respective wire resistances of pickup coils 174, 176 and driver coil 178. It will be noticed, however, that the output of the conductor from the north pole end N of pickup coil 174 is joined with the output of the wire conductor from the south pole end S of second pickup coil 176. These joined outputs are then fed to adder 182 as $A_1$. $A_2$ is derived from the wire conductor output adjacent to north pole end N of second pickup coil 176. The adder 182 combines $V_{F1}$ and $V_{F2}$ to provide $V_F$ approximating 0 when $A_2$ $(V_{F2}-V_{F1})$ approximates or equals $A_1$ $(V_{F1})$.

Figure 11:
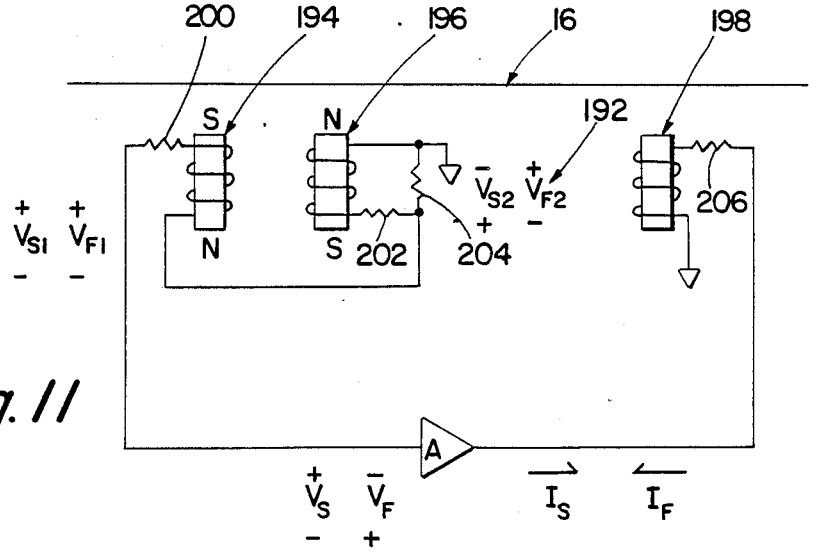
FIG. 11 A schematic view of a circuit of another embodiment of the present invention.

Another circuit 192 is shown in FIG. 11. Circuit 192 also includes a first pickup coil 194, a second pickup coil 196, a driver coil 198 and four resistors 200, 202, 204, 206. Circuit 192 also utilizes a dual coil pickup system, wherein the first and second pickup coils 194, 196 are coupled in series. Resistor 204 forms a voltage divider with the second coil resistance 202, that attenuates voltage $V_{F2}$. Through a proper choice of a resistor 204, this reduced magnitude of voltage $V_{F2}$, when combined with $V_{F1}$, approximates zero. It will be appreciated that resistor 204 can be replaced by other components such as a capacitor, an inductor, or a combination of components to provide a frequency-dependent attenuator network, and the like, to compensate for phase and gain anomalies introduced by the pickup, driver or amplifier.

Figure 12:
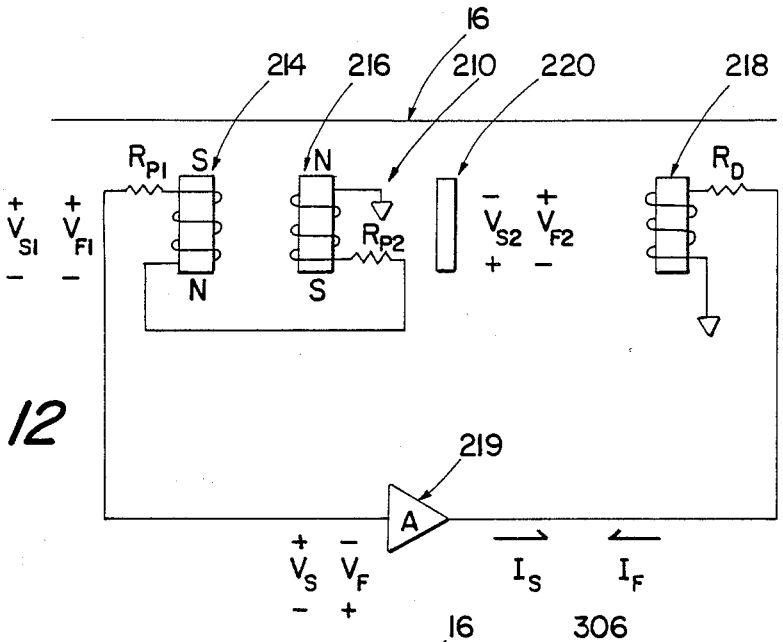
FIG. 12 A schematic view of a circuit of another embodiment of the present invention.

Another circuit 210 is shown in FIG. 12. Circuit 210 includes a first pickup coil 214, a second pickup coil 216, a single driver coil 218 and an amplifier 219. The unbalancing means of circuit 210 comprises a generally planar shunt plate 220, that is comprised of a magnetically permeable material such as steel.

The shunt plate 220 is placed in close proximity to the second pickup coil 216. The shunt plate 220 attracts a portion of the magnetic field generated by the driver coil 218. If not for the attraction of the shunt plate 220, this portion of the magnetic field generated by the driver coil 218 would otherwise pass through the second pickup coil 216. By diverting this portion of the magnetic field of the driver 218, the voltage $V_{F2}$ is lessened, causing $V_{F2}$ to approximate the opposing voltage $V_{F1}$ picked up by the first pickup coil 214. Preferably, the shunt plate 220 should attract a sufficient amount of the driver's magnetic field so that the combined voltage $V_F$ approximates zero. Although the circuit 210 is shown as having a dual-coil pick-up connected in series, similar results would apply if the first and second pick-up coils 214, 216 were coupled in parallel. Although the shunt plate shown in FIG. 12 comprises a generally planar steel plate in close proximity to the second pickup coil 218, it will be appreciated that the unbalancing effect caused by the shunt plate 220 will occur if the magnetically permeable shunt plate 220 is disposed at a different location between the second pickup coil 216 and the driver 218.

Another way of providing an unbalancing means is to provide an unbalanced driver. Sustaining devices of the present invention employing an unbalanced driver are shown in FIGS. 4–6, 13–18 and 21. It will be noticed that the methods shown herein for unbalancing the driver utilize a dual coil driver system, having a first coil and a second coil, with the first driver coil being placed closer to the pickup means than the second coil is placed to the pickup means. Since the first driver coil is closer to the pickup, the intensity of the drivers' opposing magnetic fields are not equal at the pickup location. Therefore, the net magnetic field produced by the drivers is not zero at the pickup.

One can force the driver's net magnetic field of the two driver coils to be cancelled at the pickup's location by unbalancing the driver such that the field created by the second driver coil is stronger than the field created by the first driver coil. To do this, the driver must be manipulated to alter the relative strengths of the magnetic fields generated by the respective first and second driver coils. Theoretically, an appropriately unbalanced driver produces a net zero magnetic field at the pickup when the unbalancing means exactly compensates for the differences in the distance between the pickup and the respective driver coil.

Figure 4:
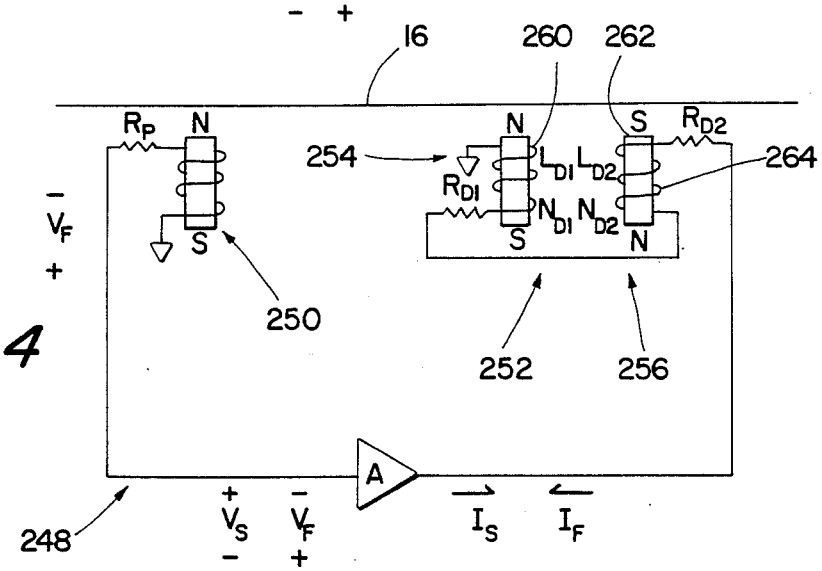
FIG. 4 A schematic view of a circuit of another embodiment of the present invention.

A first method for unbalancing the driver will be described in conjunction with FIG. 4.

Circuit 248 includes a pickup means 250, shown here as a single coil pickup means. However, pickup 250 could be a dual coil pickup means. The circuit 248 also includes a driver means 252 having a first driver coil 254 and a second driver coil 256. The first driver coil 254 includes a magnetic core 258 around which an electrical conductor, such as wire 260 is wrapped a number of turns, here designated as $N_{D1}$ turns. The second driver coil is generally similar, and includes a magnetic core 262 having a wire conductor 264 wrapped around the magnetic core 262 a predetermined number of turns, here designated as $N_{D2}$ turns. The first and second driver coils 254, 256 are coupled in series.

One method for providing an unbalancing means is to alter the cross-sectional area of the magnetic cores 258, 262 of the respective first and second driver coils 254, 266. By providing the magnetic core 258 of the first driver coil 254 with a smaller cross-sectional area than the magnetic core 262 of the second driver coil 256, less magnetic flux is generated by the first driver coil 254, since an equal amount of amplifier current flows through the series wired driver coils 260, 264. Through a proper design of the respective cross-sectional areas of the magnetic cores 258, 262, taking into account the material from which the magnetic cores 258, 262 are made, the distance between the magnetic cores 258, 262, and the distance between each of the magnetic cores 258, 262 and the pickup means 250, the driver 252 can be appropriately unbalanced so that the opposing magnetic fields generated by the first and second driver coils 254, 256 cancel one another at the location of the pickup 250.

Figure 5:
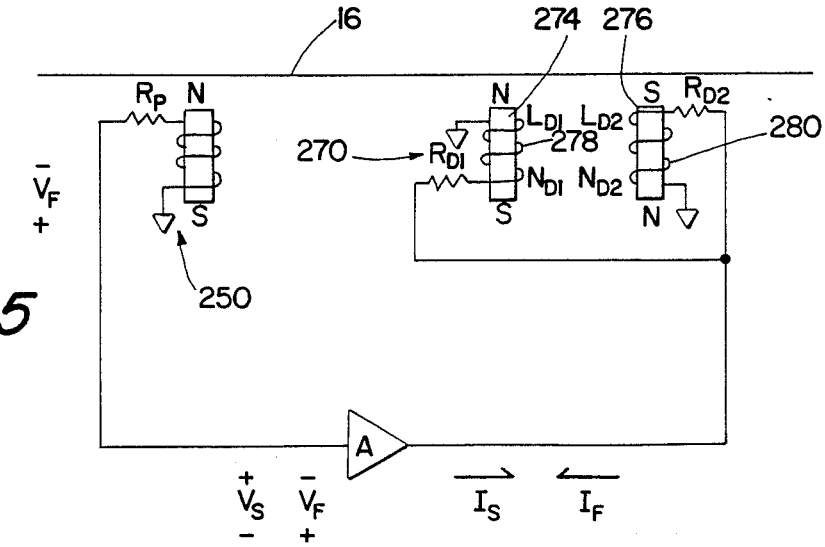
FIG. 5 A schematic view of a circuit of another embodiment of the present invention.

Another method of providing an unbalanced driver through a proper selection of the size of the magnetic cores of a driver coil is shown in FIG. 5.

Circuit 268 also includes a first and second driver coil 270, 272, each of which include a magnetic core 274, 276 and an electrical conductor, such as wires 278, 280 wrapped around each of the respective magnetic cores 274, 276, a predetermined number of turns, $N_{D1}$, and $N_{D2}$, respectively. The primary difference between circuit 268 (FIG. 5) and circuit 248 (FIG. 4) is that the driver coils 270, 272 of circuit 268 are coupled in parallel, whereas the driver coils 254, 256 of circuit 248 are coupled in series.

The cross-sectional areas of the magnetic cores 274, 276 of the respective first and second driver coils 270, 272 can be altered to unbalance the driver. By providing the magnetic core 274 of the first driver coil 270 with a smaller cross-sectional area than the magnetic core 276 of the second driver coil 272, magnetic imbalance is achieved. The flux radiated by larger core 276 is more focused vertically, resulting in less flux radiated horizontally to pickup 250 than by core 274. Through a proper selection of core material and relative spacing, the opposing magnetic fields of the first and second driver coils 270, 272 can be cancelled at the location of the pickup means 250.

Another method of providing an unbalancing means in the sustain circuit 248 (FIG. 4) is by altering the magnetic permeability of the magnetic cores 258, 262 of the respective first and second driver coils 254, 256. By constructing the magnetic core 258 of the first driver coil 254 from a material having less magnetic permeability than that material to construct the magnetic core 262 of the second driver coil 256, less magnetic flux is generated by the first driver coil 254. Through a proper selection of the materials from which the magnetic cores 258, 262 are made, the driver coils 254, 256 can be sufficiently unbalanced so that the magnetic fields generated by the first and second driver coils 254, 256 cancel each other at the location of the pickup 250.

Another method of providing an unbalancing means is shown in connection with FIG. 5, for a circuit wherein the first and second driver coils 274, 276 are coupled in parallel. Similar to that discussed above, an unbalancing means can be provided by constructing the magnetic core 274 of the first driver coil 270 of a material having less magnetic permeability than the material from which the magnetic core 276 of the second driver coil 272 is constructed. By so doing, the flux generated by core 276 is more focused vertically, so that core 276 radiates less flux horizontally than core 274. Through a proper selection of materials from which the respective magnetic cores 274, 276 are made, the driver coils 270, 272 can be unbalanced so that the opposing magnetic fields of the driver coils 270, 272 cancel each other at the location of the pickup 250.

Another method of providing an unbalancing means is to differ the number of turns $N_{D1}$, $N_{D2}$ of the conductor around the respective magnetic cores. In circuit 248 (FIG. 4), wherein the driver coils 254, 256 are connected in series, the wire 264 wrapped around the magnetic core 262 of the second driver coil 256 is given a greater number of turns, $N_{D2}$ than the number of turns of wire 260 around the magnetic core 258 of the first driver coil 252. Thus, $N_{D2}$ is greater than $N_{D1}$. This enables the second driver coil 262 to produce an opposing magnetic field greater in magnitude than the magnetic field produced by the first driver coil 254, so that the net magnetic field of the driver is zero at the pickup means 250.

When this unbalancing method is used in connection with circuit 268, wherein the first and second driver coils 270, 272 are coupled in parallel, $N_{D2}$ should be less than $N_{D1}$. By causing $N_{D1} > N_{D2}$ the impedance of the second driver coil 272 is decreased to enable it to draw a greater amount of amplifier current than the first driver coil 270. Since magnetic energy equals (0.5) ($Li^2$), even though $L_{D1} > L_{D2}$, the magnetic flux radiated by coil 272 is greater than that radiated by coil 270. The second driver coil 272 therefore produces an opposing magnetic field greater in magnitude than the magnetic field produced by the first driver coil 270. Through proper selection of the number of turns, $N_{D1}$, $N_{D2}$ of the first and second driver coils 270, 272, the magnetic field of the first and second driver coils 270, 272 can be unbalanced so that the net magnetic field of the first and second driver coils 270, 272 is zero at the location of the pickup 250.

Figure 6:
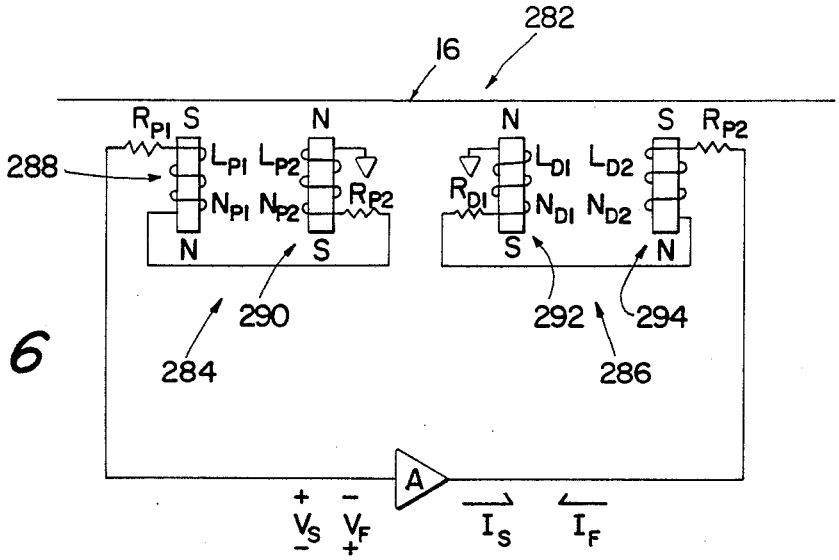
FIG. 6 A schematic view of a circuit of another embodiment of the present invention.

A circuit 282 is shown in FIG. 6, as including a pickup means 284 and a driver means 286. The pickup means 284 comprises a dual coil pickup having a first pickup coil 288 and a second pickup coil 290. Similarly, the driver means 286 comprises a dual coil driver having a first driver coil 292 and a second driver coil 294. The unbalancing means described above in connection with the "unbalanced pickup" and "unbalanced driver" can be used with this particular circuit. For example, an unbalancing means can be achieved by altering the cross-sectional areas of the magnetic cores of the pickup coils 288, 290 or driver coils, by altering the number of turns $N_{P1}$, $N_{P2}$, $N_{D1}$, $N_{D2}$ to achieve an unbalanced pickup or driver, respectively, and by altering the materials from which the respective cores are composed in a manner similar to that described above. As discussed in connection with the circuits described above, the alterations of the number of turns, cross-sectional areas of the core, or materials of the core are performed so that either the magnetic field generated by the driver 286 is zero at the location of the pickup 284, or so that the magnetic field sensed by the pickup from that magnetic field generated by the driver is zero.

Figure 13:
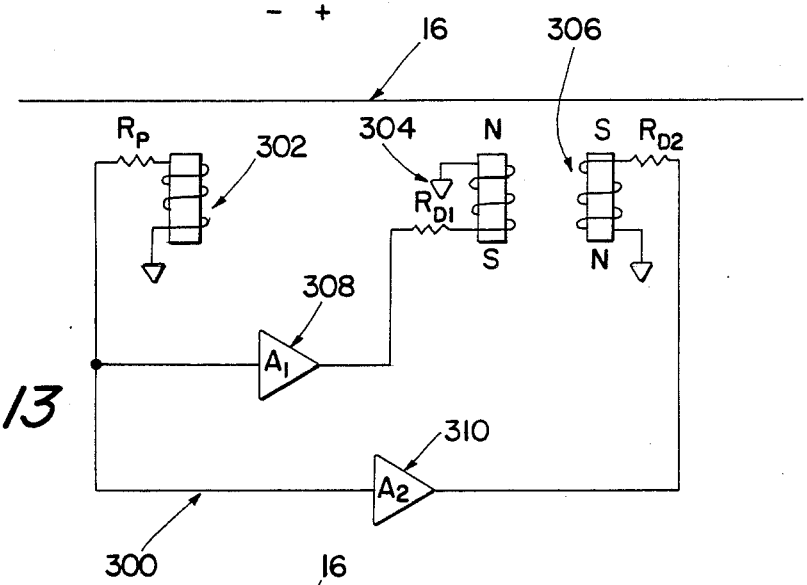
FIG. 13 A schematic view of a circuit of another embodiment of the present invention.

Circuit 300 is shown in FIG. 13 as including a pickup means 302, a first driver coil 304, a second driver coil 306, a first amplifier 308 having a gain of $A_1$ and a second amplifier 310 having a gain of $A_2$. First amplifier 308 is interposed between the pickup means 302 and the first driver coil 304. The second amplifier 310 is coupled between the pickup means 302 and the second driver coil 306. This circuit 300 is unbalanced by providing separate amplifiers 308, 310, having different gains $A_1$, $A_2$. The gain $A_2$ of second amplifier 310 is greater than the gain $A_1$ of first amplifier 308. Since the second amplifier 310 has a higher gain, the second driver coil 306 receives a greater drive current, and produces a stronger magnetic field than first driver coil 304. This greater drive current and stronger magnetic field oppose the first driver coil's 304 magnetic field, so that the net magnetic field of the two driver coils 304, 306 is cancelled at the pickup means 302.

Figure 14:
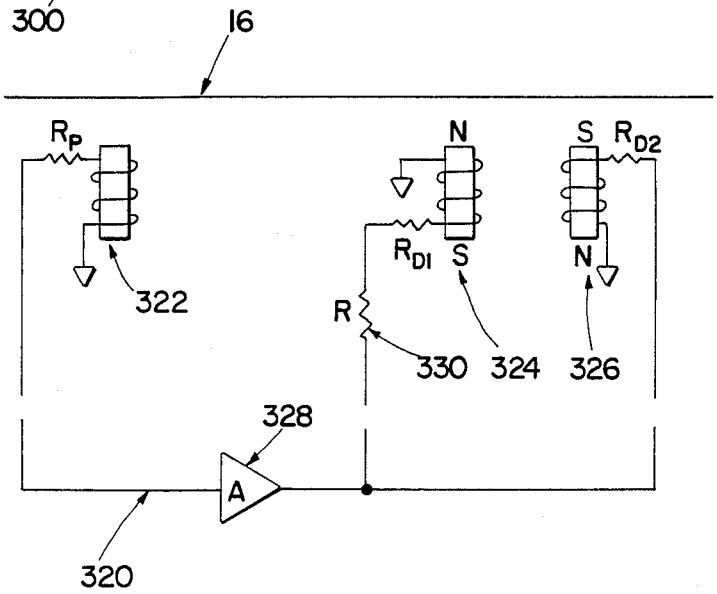
FIG. 14 A schematic view of a circuit of another embodiment of the present invention.
Figure 15:
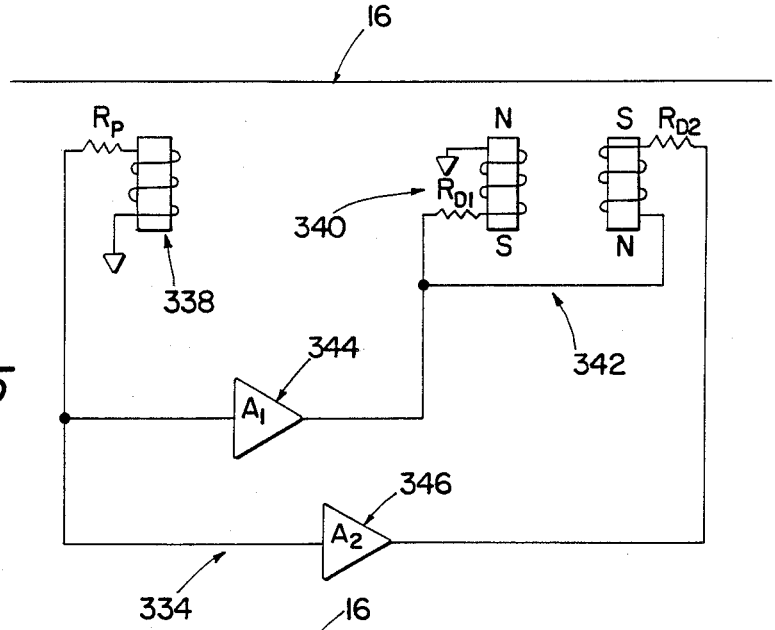
FIG. 15 A schematic view of a circuit of another embodiment of the present invention.
Figure 16:
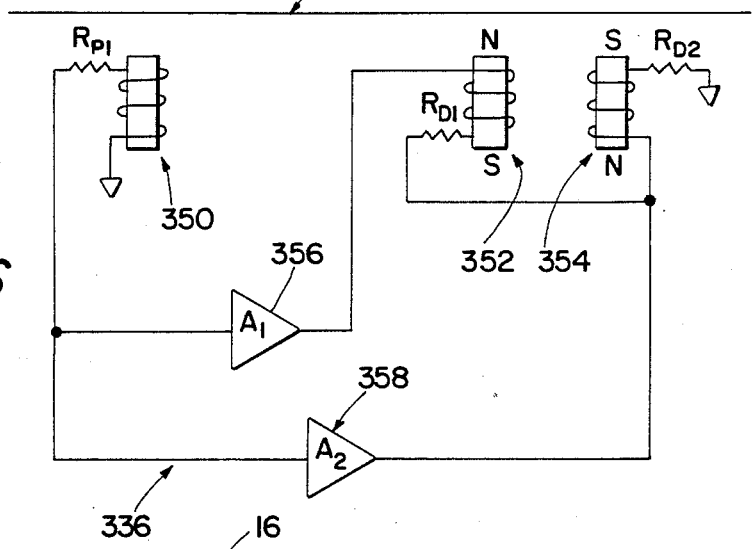
FIG. 16 A schematic view of a circuit of another embodiment of the present invention.

Another circuit 320 showing an unbalancing means is presented in FIG. 14. FIG. 14 shows a circuit 320 having a pickup means 322, a first driver coil 324, a second driver coil 326 and an amplifier 328. It will be noticed that the first and second driver coils 324, 326 are coupled in parallel. A resistor 330 is coupled between the amplifier 328 and the first driver coil 324 to attenuate the amount of current delivered to the first driver coil 324 by the amplifier 328. It will be appreciated that this resistor 330 can be replaced with other components such as a capacitor, an inductor, or combination of components to provide a frequency-dependent attenuator network, and therefore compensate for phase and gain anomalies introduced by the pickup, driver or amplifier.

The resistor 330 decreases the magnetic field generated by the first driver coil 324, so that the magnetic field generated by the first and second driver coils 324, 326 is equal and opposing, and therefore cancels at the location of the pickup means 322.

Circuit 334 (FIG. 15) and circuit 336 (FIG. 16) are generally equivalent circuits illustrating another manner for creating an unbalancing means with driver coils coupled in series. Circuit 334 includes a pickup means 338, first and second series-coupled driver coils 340, 342, and first and second amplifiers 344, 346 having gains $A_1$, $A_2$ respectively. First amplifier 344 is coupled between the pickup means 338, and the wire conductor adjacent to the south pole end S of the first driver coil 340. Second amplifier 346 is coupled between the pickup means and the south pole end S of the second driver coil 342. The first amplifier 344 drives the first driver coil 340, and the second amplifier 346 drives the second driver coil 342. To create a proper unbalancing means, the gain $A_2$ of the second amplifier 346 should be greater than twice the gain $A_1$ of the first amplifier 344. Thus, $A_2 > 2A_1$. This provides the second driver coil 342 with a higher differential amplifier voltage for producing a stronger magnetic field to oppose the magnetic field generated by the first driver coil 340. Through a proper selection of amplifier gains, the net magnetic field of the first and second drivers 340, 342 is cancelled at the location of the pickup 338.

Circuit 336 (FIG. 16) shows an alternate circuit arrangement which includes a pickup means 350, a first driver coil 352, a second driver coil 354, a first amplifier 356 having gain $A_1$, and a second amplifier 358 having gain $A_2$. First amplifier 356 is coupled between the pickup means 350 and the north pole end N of the first driver coil 352. Second amplifier 358 is coupled between the pickup means 350 and the north pole end N of the second driver coil 354. The gains of the first amplifier 356 and second amplifier 358 are chosen so that the gain $A_1$ of the first amplifier is less than twice the gain $A_2$ of the second amplifier ($A_1 < 2A_2$). Similar to that discussed in connection with circuit 334 of FIG. 16, this arrangement provides the second driver coil 354 with a higher differential amplifier voltage to thereby produce a stronger magnetic field to oppose the magnetic field generated by the first driver coil, to therefore provide a net magnetic field that is cancelled at the pickup means 350.

Figure 17:
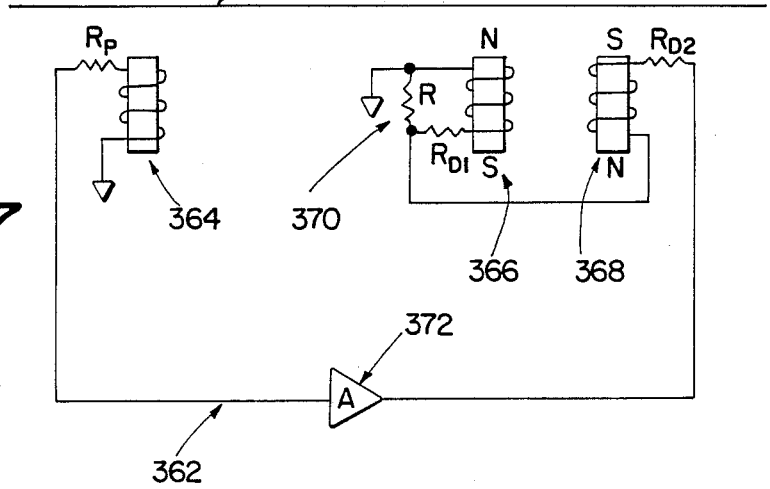
FIG. 17 A schematic view of a circuit of another embodiment of the present invention.

Another manner for providing an unbalancing means to a sustain system is shown in FIG. 17, in conjunction with circuit 362. Circuit 362 includes a pickup means 364, a first driver coil 366, a second driver coil 368, and a resistor 370. Resistor 370 shunts a portion of the current from amplifier 372 that would otherwise be directed through the first driver coil 366. This lessens the magnetic field generated by the first driver coil 366. As will be appreciated, resistor 370 can be replaced with other components, such as a capacitor, a resistor, an inducer, or a combination of components to provide a frequency-dependent network, and therefore compensate for phase and gain anomalies introduced by the pickup, driver or amplifier.

Figure 18:
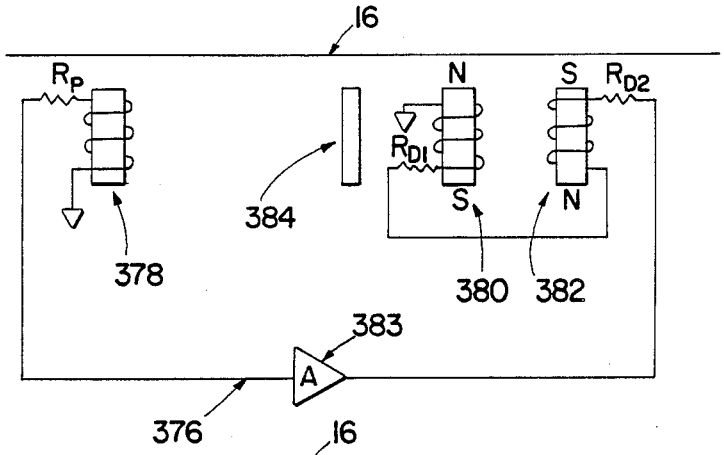
FIG. 18 A schematic view of a circuit of another embodiment of the present invention.

Another method for providing an unbalancing means is shown in circuit 376 of FIG. 18. Circuit 376 includes a pickup 378, a first driver coil 380, a second driver coil 382, an amplifier 383 coupled between the pickup 378 and driver coils 380, 382, and a shunt plate 384. Shunt plate 384 is similar to the shunt plate 220 discussed in connection with circuit 312 (FIG. 12). Shunt plate 384 is placed in close proximity to the first driver coil 380. The shunt plate 384 is preferably a generally planar steel plate. Preferably, the shunt plate is approximately 58 millimeters long and 21.4 millimeters wide, and is comprised of a material such as 1.5 millimeter thick cold-rolled steel.

The shunt plate 384 attracts a portion of the magnetic field generated by the first driver coil 380, that would otherwise be present at the pickup 378. This decreases the magnetic field radiated toward the pickup by the first driver coil 380, so that the net magnetic field of the first and second driver coils 380, 382 is cancelled at the pickup. Although the first and second driver coils 380, 382 are shown in FIG. 18 as being coupled in series, a similar effect would occur if the first and second driver coils 380, 382 were coupled in parallel. It will be appreciated that the unbalancing effect caused by the shunt plate occurs whenever a magnetically permeable material is disposed between pickup 378 and the first driver coil 380.

Figure 19:
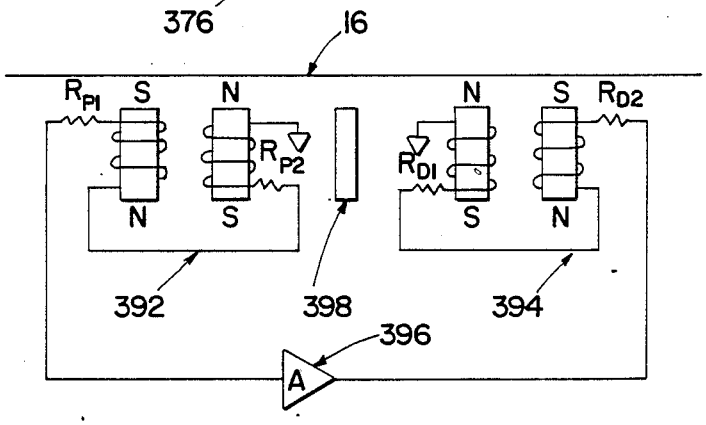
FIG. 19 A schematic view of a circuit of another embodiment of the present invention.

Another circuit 390 is shown in FIG. 19. Circuit 390 includes a dual coil pickup means 392, a dual coil driver means 394, an amplifier 396, and a shunt plate 398. Although the pickup means 392 and the driver means 394 are shown with their respective first and second coils wired in series, it will be appreciated that the same results will be obtained when the respective first and second driver and pickup coils are wired in parallel. The shunt plate 398 may be placed anywhere between the pickup and driver. The shunt plate 398 is similar to shunt plate 384 disclosed in connection with circuit 376 of FIG. 18. Shunt plate 398 is provided to simultaneously unbalance the pickup and driver to minimize direct magnetic feedback.

Figure 20:
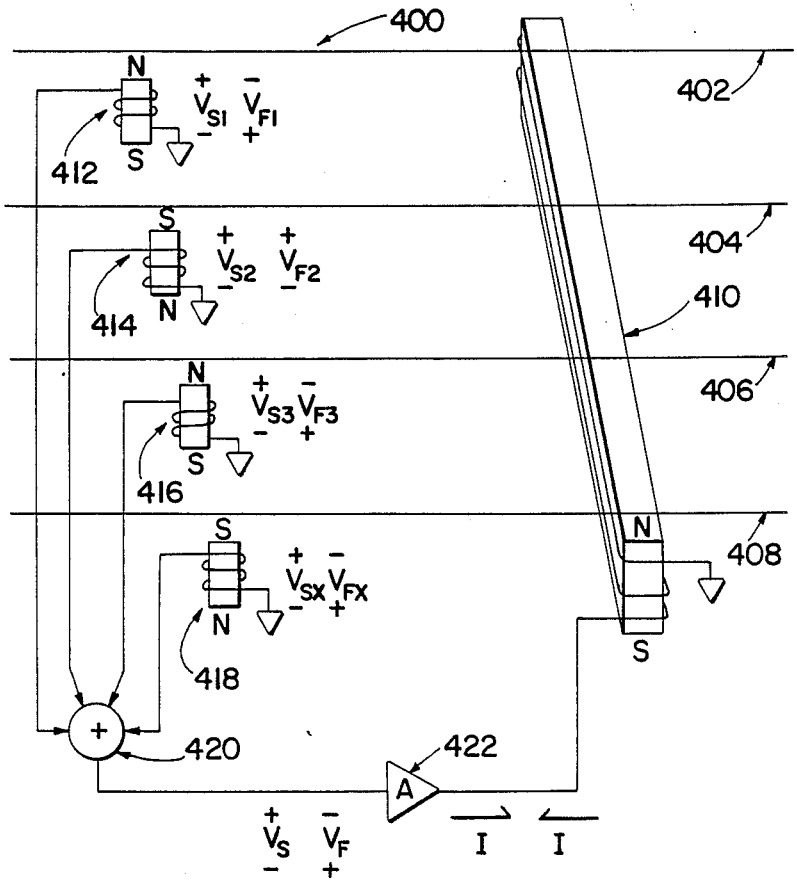
FIG. 20 A schematic view of a circuit of another embodiment of the present invention.
Figure 21:
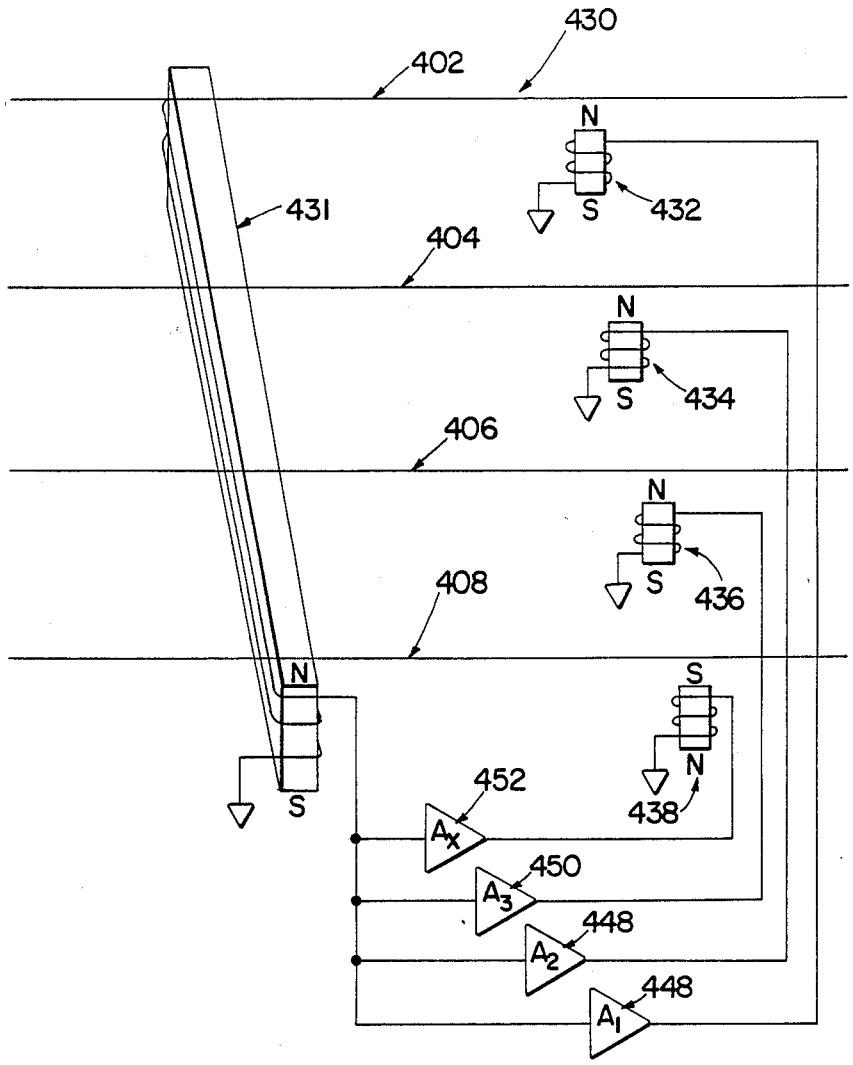
FIG. 21 A schematic view of a circuit of another embodiment of the present invention.

An alternate circuit 400 is shown in FIG. 20 for producing an unbalancing means in a sustain circuit wherein multiple pickups are utilized. Circuit 400 includes a driver 410 that bridges each of the four strings 402, 404, 406, 408 of the musical instrument. Although the circuit 400 is shown as being used with an instrument having four strings, it will be appreciated that the circuit would also function if the number of strings were decreased or increased from the four strings shown. Multiple pickup means, such as first pickup means 412, second pickup means 414, third pickup means 416, and fourth pickup means 418 are provided, with one pickup means for each of the strings. Further, each individual pickup means 412, 414, 416, 418 can consist of one or more pickup coils, as the driver 410 may also consist of one or more driver coils. The pickup coils 412, 414, 416, 418 are spaced equidistantly from the driver 410. Additionally, half of the pickup coils, such as pickup coils 412, 416 have one magnetic orientation, which is shown in FIG. 20 as a N-S orientation. The alternating pickups, pickups 414 and 418, have an opposite orientation, here shown as a S-N orientation. The outputs from the pickups 412, 414, 416, 418 are combined in the adder 420 and amplified by amplifier 422 to provide a common current $I_S$ to the driver 410 for sustaining string vibration. When the opposing voltages $V_{F1}$, $V_{F2}$, $V_{F3}$, $V_{F4}$ are combined by the adder 420, their net voltage, $V_F$, approximates zero whenever the number of pickups is even. This cancellation is due to the opposing polarities of the respective voltages $V_{F1}$, $V_{F2}$, $V_{F3}$, and $V_{F4}$. If an odd number of pickups are used, or if the pickups are not spaced equally from the driver 410, the voltage $V_F$ may be made to be zero by using one or more of the unbalancing methods disclosed above, and applied to either the pickups 412, 414, 416, 418, or the driver 410.

Circuit 430 (FIG. 21) provides an alternate method of providing an unbalanced sustain system of the present invention. Circuit 430 includes a single pickup 431 that bridges each of the four shown strings 402, 404, 406, 408. Circuit 430 also includes multiple drivers, including first driver 432, second driver 434, third driver 436, and fourth driver 438. Just as circuit 400 includes individual pickups 412, 414, 416, 418 for each of the four strings shown, circuit 430 includes individual drivers 432, 434, 436, 438 for each of the four strings. Additionally, circuit 430 includes four amplifiers. These four amplifiers include first amplifier 446, which is coupled between the pickup 431 and the first driver coil 432; second amplifier 448, which is coupled between the pickup 431 and the second driver 434; third amplifier 450, which is coupled between the pickup 431 and the third driver 436; and the fourth amplifier 452, which is coupled between the pickup 431 and the fourth driver 438.

Each of the four drivers 432, 434, 436, 438 are located an equal distance from the pickup 431, and are configured so that the drivers may act individually on separate strings 402, 404, 406, 408. Each individual driver 432, 434, 436, 438 may consist of one or more driver coils, and the pickup 431 may consist of one or more pickup coils. The drivers may be driven by separate amplifiers, such as amplifiers 446, 448, 450, 452. Alternately, the drivers may be driven by a single amplifier (not shown). It will be noticed that half of the drivers (here, drivers 432 and 436) have one polarity (N-S), whereas the alternating drivers, drivers 434 and 438, have an opposite magnetic polarity (S-N). The opposing magnetic fields produced by the drivers cancel one another whenever the number of drivers is even. If the number of drivers is odd, or if the drivers are not equally spaced from the pickup 431, the opposing fields can be cancelled when one or more of the unbalancing methods disclosed above are applied to either the pickup, the driver, or both.

The following additional information is pertinent to all or some of the embodiments discussed above.

The pickup unbalancing methods described above are illustrated by sustain systems comprising circuits having a single driver coil. The same principles apply however, when a driver has two or more driver coils, since the pickup unbalancing methods compensate for the net magnetic field produced by the combination of the collective driver coils.

The driver unbalancing methods are illustrated above by sustain systems wherein a single coil pickup is used. However, the same principles apply when the pickup has two or more pickup coils, since the driver unbalancing methods compensate for the net magnetic feedback voltage produced by the combination of the collective pickup coils.

It will also be appreciated that in the illustrations, the pickup and driver magnetic cores are shown as being oriented parallel to one another. In practice however, the cores need not be placed in this parallel orientation. In fact, all non-orthaganol coils must be considered when determining the net magnetic field for net magnetic feedback voltage.

In practice, no unbalancing method will completely eliminate directly coupled magnetic feedback. This inability to achieve complete elimination is due to several practical limitations in the construction of pickups and drivers. Generally however, the unbalancing methods discussed above will provide significant reductions in the undesirable effects of direct magnetic feedback, such as an uncontrolled oscillation, and the coupling of amplifier distortion and noise to the pickup. Further, user adjustable controls can be added where applicable to permit the user to manually fine-tune the degree of unbalancing, and thereby compensate for variations in the components of the system.

Although the pickup unbalancing systems and driver unbalancing systems are shown in the above illustrations as being used alone, it will be appreciated by those skilled in the art that pickup and driver unbalancing methods and systems may be used together in a sustain system to achieve a desired level of performance. Further, the dual coil pickup and driver unbalancing methods may be applied to lessen the effect of direct magnetic feedback radiated to other pickups on the instruments not directly related to the sustain system.

It will also be appreciated that although dual coil pickup systems and dual coil driver systems are shown, the principles discussed in the embodiment will also apply when multiple coil systems (three or greater) are used. It will also be appreciated that the relative magnetic polarities shown in the embodiments discussed above may be reversed to obtain the same results as described throughout the invention.

Although the invention has been described in detail with reference to the illustrated preferred embodiments, variations and modifications exist within the scope and spirit of the invention as described and as defined in the following claims.

What is claimed is:

1. A sustaining device for prolonging the vibration of a string of a stringed musical instrument having magnetic pickup means responsive to a change in the magnetic field caused by vibration of the string, the sustaining device comprising a magnetic string driver means in magnetic proximity to the pickup means, an amplifier means coupled between the pickup means and the driver means for amplifying current from the pickup means to the driver means to impart sufficient magnetic drive energy to the driver means to produce sustained vibration of the string, and unbalancing means for creating a magnetic imbalance between the pickup means and the driver means to minimize direct magnetic feedback between the pickup means and the driver means.

2. The sustaining device of claim 1 wherein said pickup means includes a first pickup coil and a second pickup coil, the second coil being placed closer to the driver means than the first coil.

3. The sustaining device of claim 2 wherein each of the first and second pickup coils includes a core portion having a cross-sectional area, and the unbalancing means comprises the cross-sectional area of the first pickup coil being greater than the cross-sectional area of the second pickup coil.

4. The sustaining device of claim 3 wherein the unbalancing means comprises, the material from which the core portions of the first and second pickup coils are made, and the spacing between the pickup means and the driver means being selected so that magnetic field sensed by each of the first and second pickup coils, from the magnetic drive energy given off by the driver means, is approximately equal in intensity and opposite in polarity.

5. The sustaining device of claim 2 wherein each of the first and second pickup coils includes a core portion comprised of a magnetically permeable material, and the unbalancing means comprises the first pickup coil core portion being comprised of a material having greater magnetic permeability that the material from which the second pickup coil core portion is comprised.

6. The sustaining device of claim 2 wherein the first pickup coil includes a core portion and electrical conductor wrapped around the core portion, and the second pickup coil includes a core portion and an electrical conductor wrapped around the core portion, and the unbalancing means comprises the electrical conductor being wrapped a greater number of times around the first pickup coil core portion than the electrical conductor is wrapped around the second pickup coil core portion.

7. The sustaining device of claim 2 wherein the unbalancing means comprises an adder means coupled between the pickup means and the transducer means for receiving the output of the first and second pickup coils, the adder means being designed to have unequal input gains, the gain from the first pickup coil being greater than the gain from the second pickup coil.

8. The sustaining device of claim 2 wherein the unbalancing means comprises an adder means coupled between the pickup means and the transducer means for receiving the output of the first and second pickup coils, and an attenuator means coupled between the second coil and the adder means.

9. The sustaining device of claim 2 wherein the first and second pickup coils are coupled in series, and wherein the unbalancing means comprises an adder means coupled between the first and second pickup coils and the driver means, the adder means including a first input and a second input, the first input being coupled to the output from the first pickup coil, and the second input being coupled to the combined outputs of the first pickup coil and the second pickup coil.

10. The sustaining device of claim 2 wherein the first and second pickup coils are coupled in series, and wherein the unbalancing means comprises an adder means coupled between the first and second pickup coils and the driver means, the adder means including a first input and a second input, the first input being coupled to the combined outputs of the first pickup coil and the second pickup coil, the second input being coupled to the output from the second pickup coil.

11. The sustaining device of claim 2 wherein the first and second pickup coils are coupled in series and wherein the unbalancing means comprises an adder means coupled between the first and second pickup coils and the magnetic string driver means, for combining the driver means magnetic drive energy picked up by the first and second pickup coils, and minimizing the driver means magnetic drive energy transmitted by the pickup means to the driver means, when $$A_1(V_{F1}-V_{F2}) \text{ approximates } A_2(V_{F2})$$

wherein $A_1$ = the gain of the adder means with respect to the difference voltage $V_{F1}-V_{F2}$.

$A_2$ = the gain of the adder means with respect to the voltage of $V_{F2}$, $V_{F1}$ = the voltage produced by the first pickup coil in response to changes in the magnetic field of the magnetic string driver means, and $V_{F2}$ = the voltage produced by second pickup coil in response to changes in the magnetic field of the magnetic string driver means.

12. The sustaining device of claim 2 wherein the first and second pickup coils are coupled in series and wherein the unbalancing means comprises an adder means coupled between the first and second pickup coils and the magnetic string driver means, for combining the driver means magnetic drive energy picked by the first and second pickup coils, and minimizing the driver means magnetic drive energy transmitted from the pickup means to the driver means when $$A_1(V_{F2}-V_{F1}) \text{ approximates } A_2(V_{F1}),$$

wherein $A_1$ = the gain of the adder means with respect to the difference voltage $V_{F1}-V_{F2}$, $A_2$ = the gain of the adder means with respect to the voltage of $V_{F1}$, $V_{F1}$ = the voltage produced by the first pickup coil in response to changes in the magnetic field of the magnetic string driver means, and $V_{F2}$ = the voltage produced by second pickup coil in response to changes in the magnetic field of the magnetic string driver means.

13. The sustaining device of claim 2 wherein the first and second pickup coils are coupled in series, and the unbalancing means comprises an attenuator means coupled between the second pickup coil and the first pickup coil.

14. The sustaining device of claim 13 wherein the attenuator means comprises a resistor means for decreasing magnetic string driver means magnetic drive energy picked up by the second pickup coil and transmitted to the amplifier means.

15. The sustaining device of claim 2 wherein the stringed musical instrument includes a plurality of generally parallel strings disposed in a plane, and the unbalancing means comprises a magnetic shunt means disposed between the second pickup coil and the transducer means, below the plane in which the strings are disposed.

16. The sustaining device of claim 14 wherein the magnetic shunt means comprises a generally planar metal plate disposed in a plane generally parallel to a plane in which the second pickup coil is disposed.

17. The sustaining device of claim 2 wherein said magnetic string driver means includes a first driver coil and a second driver coil.

18. The sustaining device of claim 1 wherein said magnetic string driver means includes a first driver coil and a second driver coil, the first driver coil being placed closer to the pickup means than the second driver coil.

19. The sustaining device of claim 18 wherein each of the first and second driver coils includes a core portion having a cross-sectional area, and the unbalancing means comprises the cross-sectional area of the first driver coil being less than the cross-sectional area of the second driver coil.

20. The sustaining device of claim 18 wherein the unbalancing means comprises, the material from which the core portions of the first and second transducer coils are made, and the spacing between the pickup means and the driver means being selected so that magnetic field sensed by the pickup means from the magnetic drive energy given off by each of the first and second driver coils, is approximately equal in intensity and opposite in polarity in the proximity of the pickup means.

21. The sustaining device of claim 18 wherein each of the first and second driver coils includes a core portion comprised of a magnetically permeable material, and the unbalancing means comprises the first driver coil core portion being comprised of a material having less magnetic permeability than the material from which the second driver coil core portion is comprised.

22. The sustaining device of claim 18 wherein the first and second driver coils are coupled in series, the first driver coil includes a core portion and electrical conductor wrapped around the core portion, and the second driver coil includes a core portion and an electrical conductor wrapped around the core portion, and the unbalancing means comprises the electrical conductor being wrapped a greater number of times around the second driver coil core portion than the electrical conductor is wrapped around the first driver coil core portion.

23. The sustaining device of claim 18 wherein the first and second driver coils are coupled in parallel, the first driver coil includes a core portion, and the second driver coil includes a core portion and an electrical conductor wrapped around the core portion, and the unbalancing means comprises the electrical conductor being wrapped a greater number of times around the first driver coil core portion than the electrical conductor is wrapped around the second driver coil core portion.

24. The sustaining device of claim 18 wherein the amplifier means comprises a first amplifier coupled between the pickup means and the first driver coil, and a second amplifier coupled between the pickup means and the second driver coil, and the unbalancing means comprises the second amplifier having a higher gain than the first amplifier.

25. The sustaining device of claim 18 wherein, the first and second driver coils are coupled in series, and the amplifier means comprises a first amplifier coupled between the pickup means and the first driver coil, and a second amplifier coupled between the pickup means and the second driver coil, and the unbalancing means comprises the second amplifier having a gain greater than twice the gain of the first amplifier.

26. The sustaining device of claim 18 wherein the first and second driver coils are coupled in series, and the amplifier means comprises a first amplifier coupled between the pickup means and the first driver coil, and a second amplifier coupled between the pickup means and the second driver coil, and the unbalancing means comprising the first amplifier having a gain less than twice the gain of the second amplifier.

27. The sustaining device of claim 18 wherein the first and second driver coils are coupled in parallel, and the unbalancing means comprises an attenuator coupled between the pickup means and the first driver coil.

28. The sustaining device of claim 18 wherein the first and second driver coils are coupled in series, and the unbalancing means comprises an attenuator means coupled to the first driver coil.

29. The sustaining device of claim 18 wherein the stringed musical instrument includes a plurality of generally parallel strings disposed in a plane, and the unbalancing means comprises a magnetic shunt means of magnetically permeable material disposed between the first driver coil and the pickup means, below the plane in which the stings are disposed.

30. The sustaining device of claim 17 wherein the magnetic shunt means comprises a generally planar steel plate disposed in a plane generally parallel to the plane in which the first driver coil is disposed.

31. The sustaining device of claim 1 wherein the stringed musical instruments includes a plurality of generally parallel strings disposed in a plane, and the unbalancing means comprises a magnetic shunt means disposed between the pickup means and the transducer means, below the plane in which the strings are disposed.

32. The sustaining device of claim 30 wherein the magnetic shunt means comprises a generally planar metal plate having a longer dimension and a shorter dimension, the longer dimension extending generally perpendicular to the strings.

* * * * *

UNITED STATES PATENT AND TRADEMARK OFFICE
CERTIFICATE OF CORRECTION

PATENT NO. : 4,941,388

DATED : July 17, 1990

INVENTOR(S) : Alan A. Hoover and Gary T. Osborne

It is certified that error appears in the above-identified patent and that said Letters Patent is hereby corrected as shown below:

IN THE DRAWINGS:

In Sheet 1, Fig. 1, "30" should be --11--.
In Sheet 1, Fig. 2, a lead should connect $N_{P2}$ to wire 72.
In Sheet 1, Fig. 2, the number --64-- should be inserted adjacent to 70, and an arrow-headed lead line should be inserted to extend from 64 to point generally to the relatively rightwardly placed pickup coil.
In Sheet 1,Fig. 2, the number --58-- should be inserted generally below, and to the right of pickup coils 62, 64, and an arrow-headed lead line should be inserted to extend from 58 to a point generally adjacent to the pickup means (See e.g. 92 of Fig. 3)
In Sheet 2, Fig. 4 --258-- should be inserted near 254, and a lead line should be inserted to extend to the magnetic core of first driver coil 254.
In Sheet 2, Fig. 5, --272-- should be inserted adjacent to the right driver coil, and an arrow-headed lead line should be inserted to extend to the right driver coil.
In Sheet 2, Fig. 5, --268-- should be inserted near Fig. 5, and an arrow-headed lead line should be inserted to extend generally toward the circuit.
In Sheet 3, Fig. 7, --112-- should be inserted near Fig. 7, and an arrow-headed lead line should be inserted to extend generally toward the circuit.
In Sheet 3,Fig. 7, "$G_1$" should be deleted, and --$A_1$-- inserted therefor; and "$G_2$" should be deleted and --$A_2$-- inserted therefor.

UNITED STATES PATENT AND TRADEMARK OFFICE
CERTIFICATE OF CORRECTION

PATENT NO. : 4,941,388

DATED : July 17, 1990

INVENTOR(S) : Alan A. Hoover and Gary T. Osborne

It is certified that error appears in the above-identified patent and that said Letters Patent is hereby corrected as shown below:

In Sheet 3, Fig. 8, delete "$G_1$" and insert therefor --$A_1$--; and delete "$G_2$" and insert therefor --$A_2$--.
In Sheet 4, Fig. 9, delete "$G_1$", and insert therefor --$A_1$--; and delete "$G_2$" and insert therefor --$A_2$--.
In Sheet 4, Fig. 10, delete "$G_1$" and insert therefor --$A_1$--; delete "$G_2$" and insert therefor --$A_2$--; and delete "156", and insert therefor --186--.
In Sheet 5, Fig. 12, insert --312-- near Fig. 12, and an arrow-headed lead line should be inserted to extend from 312 generally toward the circuit.
In Sheet 5, Fig. 14, the three vertical lines shown as having a "break" should be unbroken vertical lines.
In Sheet 7, Fig. 19, insert --390-- near Fig. 19, and an arrow-headed lead line should be inserted to extend from 390 generally towad the circuit.
In Sheet 8, Fig. 21, at second driver 434, "N" should be deleted, and --S-- inserted therefor; and "S" should be deleted and --N-- inserted therefor.

IN THE SPECIFICATION AND CLAIMS:

At column 2, line 17, delete "P", and insert therefor --$N_P$--.
At column 5, line 20, delete "sustained"; and insert therefor --sustain--.
At column 6, line 3, delete "core 30" and insert therefor --coil 11--.

UNITED STATES PATENT AND TRADEMARK OFFICE

CERTIFICATE OF CORRECTION

PATENT NO. : 4,941,388

DATED : July 17, 1990

INVENTOR(S) : Alan A. Hoover and Gary T. Osborne

It is certified that error appears in the above-identified patent and that said Letters Patent is hereby corrected as shown below:

At column 6, line 6, delete "V = N(DP/DT)" and insert therefor --$v = N_p$ (DP/DT)--.
At column 6, line 9, delete "core 30" and insert therefor --coil 11--.
At column 9, line 42, delete "coil S", and insert therefor --coils--.
At column 9, line 63, delete "next", and insert therefor --net--.
At column 9, line 66, delete "area S", and insert therefor --areas--.
At column 14, line 21, delete "274, 276", and insert therefor --270, 272--.
At column 15, line 58, delete "is" and insert therefor --are--.
At column 15, line 58, delete "cancels",and insert therefor --cancel--.
At column 21, line 35, delete "14", and insert therefor --15--.
At column 22, line 65, delete "17", and insert therefor --29--.

Signed and Sealed this

Twenty-seventh Day of April, 1993

*Attest:*

MICHAEL K. KIRK

*Attesting Officer*

*Acting Commissioner of Patents and Trademarks*